US007481165B2

(12) United States Patent
Weichmann

(10) Patent No.: US 7,481,165 B2
(45) Date of Patent: Jan. 27, 2009

(54) METHOD FOR CONTROLLING INKING IN AN OFFSET PRESS

(75) Inventor: Armin Weichmann, Kissing (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 318 days.

(21) Appl. No.: 11/303,700

(22) Filed: Dec. 16, 2005

(65) Prior Publication Data

US 2006/0130687 A1 Jun. 22, 2006

(30) Foreign Application Priority Data

Dec. 18, 2004 (DE) ..... 10 2004 061 469

(51) Int. Cl.
*B41F 31/02* (2006.01)

(52) U.S. Cl. ..... 101/484; 101/365

(58) Field of Classification Search ..... None
See application file for complete search history.

(56) References Cited

U.S. PATENT DOCUMENTS

| | | | | |
|---|---|---|---|---|
| 5,029,527 | A | 7/1991 | Jeschke et al. | |
| 5,163,368 | A * | 11/1992 | Pensavecchia et al. | 101/136 |
| 5,625,758 | A * | 4/1997 | Schneider et al. | 358/1.15 |
| 5,791,251 | A * | 8/1998 | Kistler et al. | 101/484 |
| 5,957,049 | A | 9/1999 | Ammeter et al. | |
| 6,564,714 | B2 * | 5/2003 | Brydges et al. | 101/484 |
| 6,684,780 | B2 * | 2/2004 | Shiraishi | 101/365 |
| 6,742,451 | B1 * | 6/2004 | Junghans | 101/365 |
| 7,000,544 | B2 | 2/2006 | Riepenhoff | |
| 2002/0174786 | A1 * | 11/2002 | Schneider | 101/352.11 |
| 2004/0020389 | A1 * | 2/2004 | Holmstead et al. | 101/484 |

FOREIGN PATENT DOCUMENTS

| | | |
|---|---|---|
| DE | 31 40 760 | 8/1982 |
| DE | 34 40 706 | 5/1986 |
| DE | 40 39 818 | 6/1992 |
| DE | 42 29 267 | 3/1994 |
| DE | 42 37 004 | 5/1994 |
| DE | 43 14 426 | 11/1994 |

(Continued)

OTHER PUBLICATIONS

Search Report dated Dec. 18, 2004 issued for corresponding German Application No. 10 2004 061 469.5.

(Continued)

*Primary Examiner*—Daniel J Colilla
*Assistant Examiner*—Yuan L Chen
(74) *Attorney, Agent, or Firm*—Cohen Pontani Lieberman & Pavane LLP

(57) ABSTRACT

In a method for controlling the inking in at least one inking unit of an offset press, namely for controlling the zonal inking that can be adjusted by inking zone actuating elements of the respective inking unit, measurement regions are measured for this purpose and actual values determined in the process are compared with predefined intended values in order to generate actuating signals for the inking zone actuating elements on the basis of the comparison between the actual values and the intended values. Control deviations between the measured actual values and the predefined intended values are modified on the basis of a model of the respective inking unit and/or on the basis of data from the subject.

23 Claims, 2 Drawing Sheets

FOREIGN PATENT DOCUMENTS

| | | |
|---|---|---|
| DE | 195 15 499 | 10/1996 |
| DE | 197 49 063 | 5/1999 |
| EP | 0 228 347 | 7/1987 |
| EP | 1 080 891 | 3/2001 |
| EP | 1 302 325 | 4/2003 |
| EP | 1 433 605 | 6/2004 |

OTHER PUBLICATIONS

Search Report dated Mar. 31, 2006 for the corresponding European Application No. 05 027 274.9-2304.

* cited by examiner

METHOD FOR CONTROLLING INKING IN AN OFFSET PRESS

BACKGROUND OF THE INVENTION

1. Field of the Invention

The invention relates to a method for controlling the inking in an offset press, wherein the inking unit has inking zone actuating elements which control zonal inking of a printing material printed with a subject and measurement regions.

2. Description of the Related Art

During printing, a printing material is moved successively through a plurality of printing units of a press, a printing ink normally being applied to the printing material in each printing unit. During collective autotype printing, as a rule the four primary colors black, magenta, cyan and yellow and, if appropriate, special colors are printed, there being a separate printing unit and therefore inking unit for each of these printing inks. The inking unit of a each printing unit has an ink metering device, the ink metering device comprising a number of inking zone actuating elements corresponding to the number of inking zones. The inking zone actuating elements are also designated ink slides or ink knives. Depending on the position of the inking zone actuating elements, printing ink is applied to an ink fountain roll, which is also designated a ductor roll. The quantity of ink applied to the ductor roll for each inking zone as a function of the inking zone actuating elements is transferred by a vibrator roll or film roll to an inking unit roll of the inking unit, which is arranged downstream of a vibrator roll or film roll. The printing ink is moved via a plurality of inking unit rolls in the direction of a forme cylinder or plate cylinder of the respective printing unit. At least one inking unit roll of the respective inking unit, serving as an ink applicator roll, rolls on the forme cylinder of a printing unit. Via the or each ink applicator roll, the printing ink accordingly arrives on at least one printing plate positioned on the forme cylinder. What is known as a transfer cylinder or rubber-covered cylinder interacts with the forme cylinder and transfers the printing ink from the forme cylinder to the printing material.

The color configuration of a printed product to be printed is defined in a prepress stage, as it is known. In this case, for example for all the printing inks to be printed and therefore for all the inking units of the press involved in the printing, what are known as area coverage values are defined for each inking zone. On the basis of these area coverage values, the inking zone actuating elements are set and therefore the zonal inking is determined.

From the prior art, it is already known to measure the inking established on the printing material during printing and, on this basis, to control the zonal inking of the inking units involved in the printing. To this end, measurement regions printed on the printing material outside a subject, what are known as print control elements, are usually measured, in this case actual values of the zonal inking determined being transmitted to a control device of the press. In the control device, the actual values are compared with predefined intended values in order to generate actuating signals for the inking zone actuating elements on the basis of the comparison between the actual values and the intended values and therefore on the basis of the control deviation between the measured actual values and the predefined intended values. In this way, automatic control of the zonal inking is already possible. It is also possible to measure regions within a subject as measurement regions and to control the zonal inking on this basis. In addition, print control elements printed outside a subject as measurement regions and regions within the subject can be measured.

When controlling the zonal inking on the basis of the measurement of print control elements, for example printed outside the subject, it is possible that, although the measured actual values agree with the predefined intended values for all the measurement regions, a deviation between actual values and intended values can be detected in the actual subject for individual separations of the inking. Hitherto, no methods for controlling the inking have been known which take account of this phenomenon.

On this basis, the present invention is based on the problem of providing a novel type of method for controlling the inking in an offset press.

SUMMARY OF THE INVENTION

According to the invention, inking parameters of the measurement regions are measured, actual values based on the measured inking parameters are determined, and the actual values are compared with predefined intended values to obtain control deviations. The control deviations between the measured actual values and the predefined intended values are modified on the basis of a model of the respective inking unit and/or on the basis of data from the subject.

In the spirit of the present invention, it is proposed to modify the control deviations between the actual values determined by measuring measurement regions and the predefined intended values on the basis of data from the subject and/or on the basis of a model of the respective inking unit. The invention is therefore based on the idea that a deviation between the actual values of the subject and the predefined intended values, although the actual values of the measurement regions agree with the predefined intended values, can depend on the character of the subject to be printed and/or on the rolling behavior and, if appropriate, oscillating behavior of the inking unit. Depending on an analysis of the subject and/or an inking unit model, the control deviations between the actual values measured on the measurement regions and the predefined intended values are accordingly modified in order to achieve agreement between intended values and actual values in the subject.

According to an advantageous development of the invention, for each inking zone of the subject, at least one measurement region is measured, a circumferential strip covered by the measurement region being smaller than a circumferential strip covered by the respective inking zone. When an area coverage value determined from the data from the subject in the circumferential strip covered by the measurement region is smaller than a predefined limiting value, the predefined intended value for the corresponding inking zone actuating element is increased or the measured actual value is reduced.

According to a further advantageous development of the invention, by using the data from the subject and from the model of the respective inking unit an area coverage value dependent on the ghosting behavior of the respective inking unit is determined for the circumferential strip covered by the measurement region and when this area coverage value is greater than a predefined limiting value, the predefined intended value for the corresponding inking zone actuating element is reduced or the measured actual value is increased.

According to a further advantageous development of the invention, depending on the model of the respective inking unit, an ink drop-off is determined and when there is a maximum of the ink drop-off in the circumferential strip covered by the measurement region, the predefined intended value for the corresponding inking zone actuating element is increased or the measured actual value is reduced. When there is a minimum of the ink drop-off in the circumferential strip covered by the measurement region, the predefined intended value for the corresponding inking zone actuating element is reduced or the measured actual value is increased.

The above advantageous developments of the invention can be used either on their own, in partial combinations or in an overall combination in the control of the inking according to the invention.

Preferred developments of the invention emerge from the following description. An exemplary embodiment of the invention will be explained in more detail, without being restricted thereto, by using the drawing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

In the following text, the present invention will be described in greater detail with reference to FIGS. 1 to 3, specifically using the example of measurement regions which are present outside a subject as print control elements. It should be pointed out that the invention can also be used in an analogous way in the case of measurement regions which lie within a subject.

Figure 1:
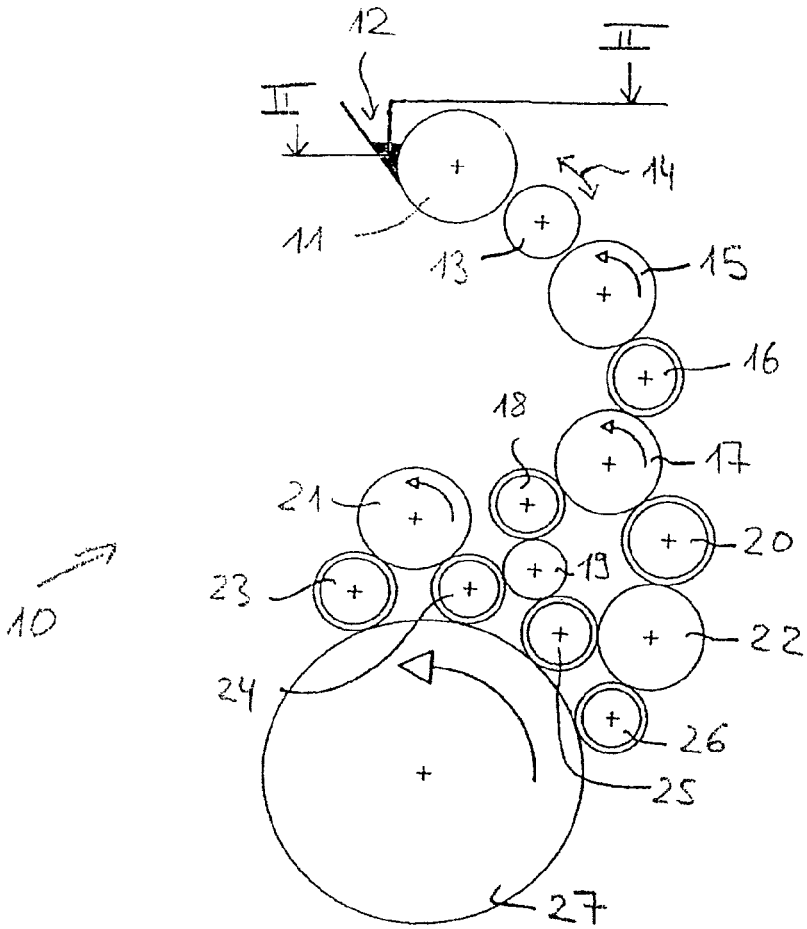
FIG. 1 shows a schematic representation of an inking unit of an offset press in order to illustrate the method according to the invention for controlling the inking.
Figure 2:
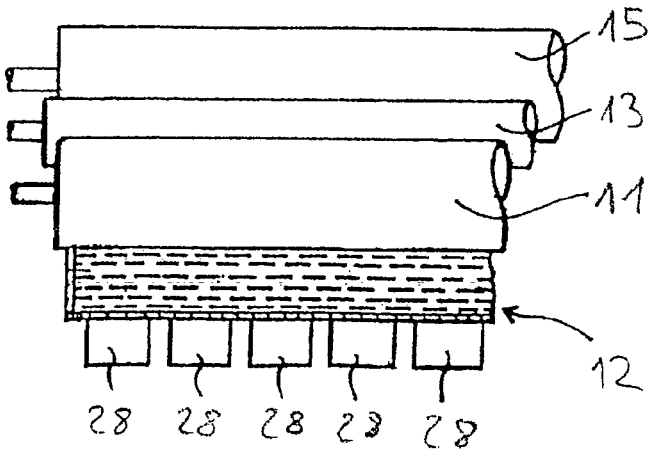
FIG. 2 shows a cross section through the inking unit of FIG. 1 along the section line II-II.

FIGS. 1 and 2 show an inking unit 10 constructed as a vibrator inking unit of an offset press, the inking unit 10 comprising a ductor roll 11 which picks up printing ink kept ready in an ink fountain 12. A vibrator roll 13 interacts with the ductor roll 11, the vibrator roll 13 picking up printing ink from the ductor roll 11 in the form of a vibrator strip, as it is known, and transferring it cyclically in the direction of the arrow 14 to an inking unit roll 15 arranged downstream of the vibrator roll 13. Arranged downstream of the inking unit roll 15 are further inking unit rolls 16, 17, 18, 19, 20, 21, 22, 23, 24, 25 and 26, the inking unit rolls 16 to 26 transporting the printing ink in the direction of a forme cylinder 27. The inking unit rolls 23, 24, 25 and 26 roll on the form cylinder 27 and are therefore also designated ink applicator rolls. Positioned on the forme cylinder is at least one printing forme, the ink applicator rolls 23 to 26 applying the printing ink to the printing forme. The quantity of ink which is transferred from the ink fountain 12 onto the ductor roll 11 depends on zonal inking of a subject to be printed. As can be gathered from FIG. 2, the ink fountain 12 is assigned inking zone actuating elements 28, as they are known, it being possible via the inking zone actuating elements 28 for the quantity of ink transferred to the ductor roll 11 for each inking zone to be adjusted. In the exemplary embodiment shown, in which the inking unit 10 is constructed as a vibrator inking unit, the inking zone actuating elements are implemented as ink slides. The ink slides and also the vibrator roll are a constituent part of what is known as an ink metering device of the inking unit.

It should be pointed out that the inking unit 10 illustrated in FIG. 1 is preferably used in sheet-fed offset presses. In the case of web-fed offset presses, use is made of inking units which, instead of ink slides, comprise what are known as ink knives as inking zone actuating elements and, instead of the vibrator roll, comprise what is known as a film roll.

Figure 3:
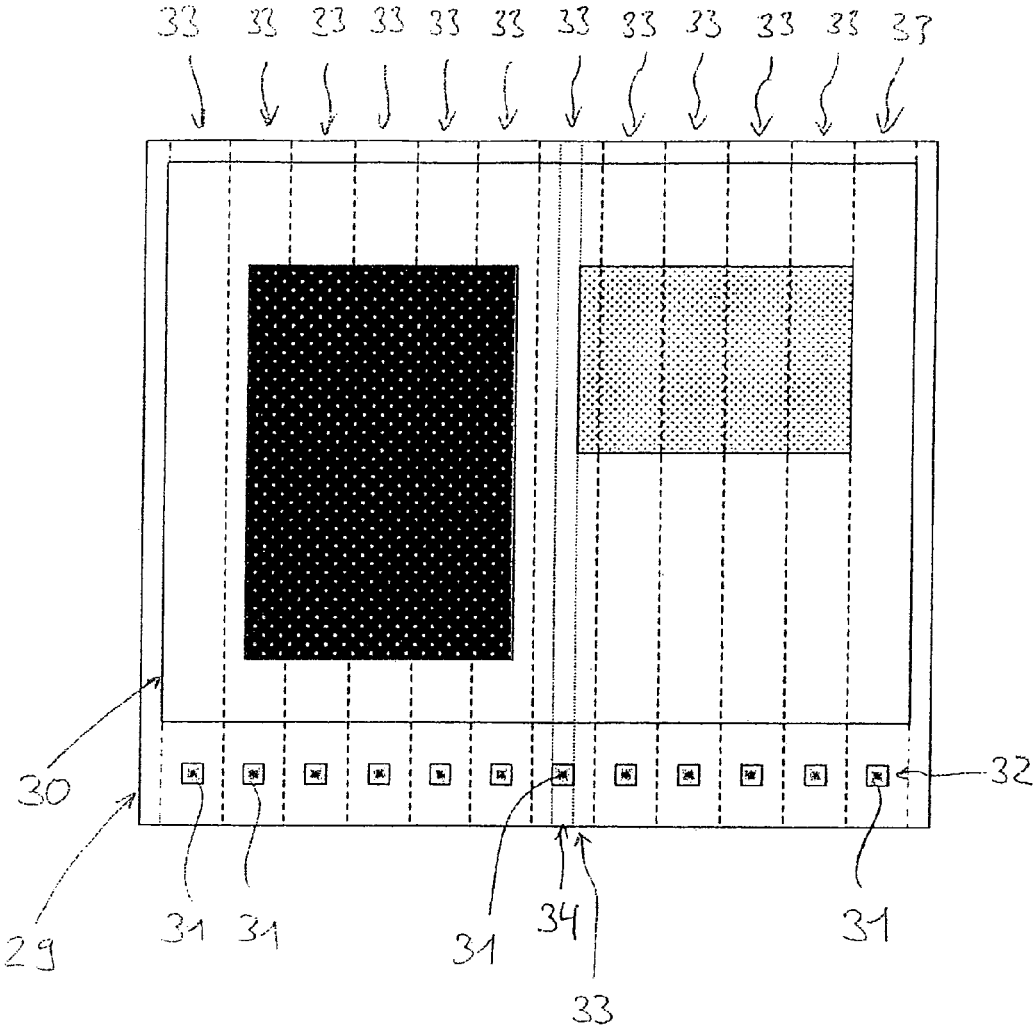
FIG. 3 shows a schematic representation of a printed sheet to be printed in order to illustrate further the method according to the invention for controlling the inking.

FIG. 3 shows in schematic form a printing material 29 which is printed with a subject 30 and, outside the subject 30, with print control elements 31, the print control elements 31 being printed onto the printing material 29 outside the actual subject 30 in the form of a control strip 32. In the exemplary embodiment shown in FIG. 3, the subject 30 printed onto the printing material 29 is subdivided into a total of twelve inking zones 33, it is possible for the printing ink applied to the printing material 29 in each inking zone 33 to be adjusted by means of a corresponding number of inking zone actuating elements 28. In the example of FIG. 3, for each inking zone 33 a print control element 31 is printed onto the printing material 29 outside the subject 30, a circumferential strip 34 covered by the print control element 31 is smaller or narrower than the circumferential strip covered by the respective inking zone 33. The print control elements 31 are measured densitometrically and/or colorimetrically and/or spectrally and actual values determined in this case are compared in a control device with predefined intended values, in order to generate control deviations. Actuating signals for the inking zone actuating elements 28 for the automatic control of the zonal inking of the subject 30 on the basis of the control deviations between the actual values obtained by measuring the print control elements 31 and the predefined intended values.

In the spirit of the present invention, it is now proposed to modify the control deviations between the actual values measured on the print control elements 31 outside the subject 30 and the predefined intended values on the basis of data from the subject 30 and/or on the basis of data from the inking unit 10.

In this way, it is possible to counteract the effect that, although the actual values registered in the region of the print control elements 31 agree with the corresponding intended values, deviations between actual values and intended values can be detected in the subject. The control deviations are preferably modified both on the basis of data from the subject and on the basis of a model of the respective inking unit.

In the case of modifying the control deviations on the basis of data from the subject, use is made of data from a digital prepress stage, which are available either as low-resolution data in PPF (print production format) or JDF (job definiation format) or as high-resolution image data. The high-resolution image data are preferably what are known as bitmaps of the individual color separations, which are normally used for the production of printing formes.

The model of the inking unit which is used for the modification of control deviations depends on the rolling behavior and, if appropriate, the oscillating behavior of the rolls of the inking unit. Data about materials used in the inking unit and also about the dynamic behavior of the inking unit can also be incorporated in the model of the inking unit.

As already mentioned, for each inking zone 33 of the subject 30, at least one print control element 31, which is printed onto the printing material 29 outside the subject 30, is measured, a circumferential strip 34 covered by the print control element 31 being smaller or narrower than a circumferential strip covered by the respective inking zone 33.

Now, it is within the spirit of the present invention, by using the data from the subject, which are preferably provided from a digital prepress stage, to determine an area coverage value for the circumferential strip covered by the print control element 31. If this area coverage value determined from the data from the subject is smaller than a predefined limiting value then, in the spirit of the present invention, the predefined intended value for the corresponding inking zone actuating element is increased or the measured actual value is reduced.

For instance, when the area coverage value determined from the data from the subject for the circumferential strip covered by the print control element 31 is between 0% and 0.5%, the intended value for the corresponding inking zone actuating element can be increased by an amount X; if, on the other hand, the area coverage value determined from the data from the subject lies between 0.5% and 2%, then the intended value can be increased by an amount Y, the amount Y being smaller than the amount X. If, on the other hand, the area coverage value determined for the circumferential strip covered by the print control element is greater than 2%, no increase is made in the intended value.

It should be pointed out that this adjustment law for the intended value is merely exemplary and that, depending on the area coverage value determined, any desired complex modification of the control deviation between intended values and actual values can be carried out.

With the above described modification of the control deviation between intended values and actual values on the basis of an area coverage value which is determined from subject data from a circumferential strip covered by the print control element, it is possible to counteract the effect that, if no ink removal takes place in the circumferential strip of the subject in which the print control element lies, printing ink builds up in the inking unit and in this way the print control element contains a higher ink density than would be the case in the event of further ink removal. Accordingly, in the spirit of the present invention, when an area coverage value determined from data from the subject in the circumferential strip covered by the print control element is smaller than a predefined limiting value, the predefined intended value for the corresponding inking zone actuating element is increased or the measured actual value is reduced.

In a development of this idea according to the invention, the circumferential strip covered by the print control element can be subdivided into a plurality of part strips, an area coverage value being determined from the data from the subject for each of the part strips. Averaging of the area coverage values of these part strips can then be used to modify the control deviation between the intended value and actual value. Alternatively, only the area coverage value of that part strip within which a measurement field of the print control element lies can be used for the adaptation of the intended value and/or the actual value and therefore for the modification of the control deviation between the intended value and actual value.

If an oscillating behavior of at least one roll of the inking unit is known from the inking unit model then, according to a further advantageous development of the invention, an area coverage value is not just determined from the subject data for the circumferential strip covered by the print control element; instead, such area coverage values are also determined for adjacent circumferential strips. Corresponding area coverage values are preferably determined from the data from the subject for a plurality of adjacent circumferential strips, circumferential strips lying further removed from the circumferential strip covered by the control element being weighted less highly than circumferential strips lying closer when changing the intended value and/or actual value.

According to a further aspect of the present invention, depending on the model of the respective inking unit, what is known as an ink drop-off is determined. An ink drop-off normally arises when the ink applicator rolls rolling on the forme cylinder cannot apply any printing ink to the printing forme because of a clamping channel for a printing plate. If it is determined from the inking unit model that a print control element is affected by such an ink drop-off, then a modification of the control deviation between the measured actual value and the predefined intended value is likewise carried out.

If, by using the ink drop-off determined from the inking unit model, it is determined that there is a maximum of the ink drop-off in the circumferential strip covered by a print control unit, then the predefined intended value for the corresponding inking zone actuating element is increased or the measured actual value is reduced. If, on the other hand, there is a minimum of the drop-off of ink in the circumferential strip covered by the print control element, then the predefined intended value for the corresponding inking zone actuating element is reduced or the measured actual value is increased.

According to a further aspect of the present invention, by using the data from the subject and from the model of the inking unit, an area coverage value dependent on the ghosting behavior of the inking unit is determined for a circumferential strip covered by the print control element. If this area coverage value dependent on the ghosting behavior is greater than a predefined limiting value then, in the spirit of the present invention, the predefined intended value for the corresponding inking zone actuating element is reduced or the measured actual value is increased. In this case, the procedure is as follows, that an area coverage value is determined for the circumferential strip covered by the print control element that lies before the circumferential strip covered by the print control element by one developed length of an applicator roll. Preferably, for the two applicator rolls with the greatest ink flow, in each case a corresponding area coverage value is determined one developed length of these rolls before the circumferential strip covered by the print control element. If the area coverage determined in this case is greater than a predefined limiting value, then the predefined intended value for the corresponding inking zone actuating element is preferably reduced.

In this way, it is possible to take account of the effect that, when the circumferential strip covered by the print control element is removed by one circumferential length of an ink applicator roll from a circumferential strip with high area coverage, the print control element indicates a lower ink density, since it is not yet possible to compensate completely for such a sharp ink drop-off after the ink applicator roll has rolled over.

In a practical exemplary embodiment, the procedure can be such that when an area coverage value between 80% and 95% is determined from the data from the subject and the inking unit model for a circumferential strip which lies one developed length before the circumferential strip covered by the print control strip, the intended value for the corresponding inking zone element is reduced by an amount A whereas, if this area coverage value lies between 95% and 100%, the intended value is reduced by an amount B, B being greater than A. In the face of area coverage values determined as less than 80%, no reduction is made in the intended value for the corresponding inking zone actuating element. Here, too, the adjustment law can again be configured as complexly as desired, depending on the ghosting behavior of the inking unit.

In the spirit of the present invention, accordingly, a method for controlling the inking is proposed in which control deviations between actual values registered on print control elements printed outside the actual subject and predefined intended values are modified on the basis of data from the subject and on the basis of an inking unit model. In this way, effects such as inking unit ghosting, ink drop-off and the fact that a circumferential strip covered by a print control element is smaller than a circumferential strip covered by the respective inking zone can be taken into account. In this way, inking during printing can be optimized considerably.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. Method for controlling inking in at least one inking unit of an offset press, the inking unit having inking zone actuating elements which control zonal inking of a printing material printed with a subject and measurement regions, wherein the subject comprises inking zones corresponding to respective inking zone actuating elements, each inking zone covering a circumferential strip and having a width, at least one measurement region being measured for each said inking zone, each said measurement region covering a circumferential strip and having a width which is less than the width of the respective said inking zone, said method comprising:

measuring inking parameters of said measurement regions;

determining actual values based on the measured inking parameters including determining an area coverage value from data from the subject in the circumferential strip covered by the measurement region;

comparing the actual values with predefined limiting values to obtain control deviations including comparing the area coverage value to a predefined limiting value;

modifying the control deviations on the basis of at least one of a model of the respective inking unit and data from the subject including, when said area coverage value is smaller than said predefined limiting value, modifying the control deviations by at least one of increasing a predefined intended value for the corresponding inking zone actuating element, and reducing the measured actual value; and generating actuating signals for the inking zone actuating elements based on the modified control deviations.

2. The method of claim 1 wherein the control deviations are modified on the basis of data from the subject.

3. The method of claim 1 wherein the control deviations are modified on the basis of data from the subject and on the basis of a model of the respective inking unit.

4. The method of claim 1 wherein the inking unit comprises a plurality of rolls which exhibit rolling behavior and oscillating behavior, the model of the respective inking unit depends on at least one of the rolling behavior and the oscillating behavior.

5. The method of claim 1 wherein the data from the subject comprises data from a digital prepress stage.

6. The method of claim 5 wherein the data from the prepress stage comprises low resolution data in one of a PPF format and a JDF format.

7. The method of claim 5 wherein the data from the subject comprises high resolution image data in the form of bitmaps which are also used to produce printing plates.

8. The method of claim 1 wherein the measurement regions are print control elements located outside the subject.

9. The method of claim 8 wherein the printing material comprises control strips, each said control element being printed in a control strip outside the subject.

10. The method of claim 1 wherein the measurement regions comprise regions within the subject.

11. The method of claim 10 wherein the measurement regions further comprise control elements outside the subject.

12. The method of claim 1 wherein said inking parameters are measured at least one of densitometrically, colorimetrically, and spectrally.

13. The method of claim 1 further comprising dividing the circumferential strip covered by the measurement region into a plurality of part strips, and determining a partial area coverage value from data from the subject in each of said part strips.

14. The method of claim 13 further comprising averaging the partial area coverage values determined from the data from the subject in each of the part strips to generate said area coverage value.

15. The method of claim 13 wherein only the partial area coverage value for the part strip in which the measurement region lies is used to modify the control deviation.

16. Method for controlling inking in at least one inking unit of an offset press, the inking unit having inking zone actuating elements which control zonal inking of a printing material printed with a subject and measurement regions, wherein the subject comprises inking zones corresponding to respective inking zone actuating elements, each inking zone covering a circumferential strip and having a width, at least one measurement region being measured for each said inking zone, each said measurement region covering a circumferential strip and having a width which is less than the width of the respective said inking zone, said method comprising:

measuring inking parameters of said measurement regions;

determining when there is a maximum ink drop off in the circumferential strip covered by the measurement region, and, when there is a maximum ink drop off, modifying the control deviations by at least one of increasing a predefined intended value for the corresponding inking zone actuating element, and reducing the measured actual value; and generating actuating signals for the inking zone actuating elements based on the modified control deviations.

17. The method of claim 16 further comprising determining an area coverage value from data from the subject in the circumferential strip covered by the measurement region, comparing the area coverage value to a predefined limiting value and, when said area coverage value is smaller than said predefined limiting value, modifying the control deviations by at least one of increasing the predefined intended value for the corresponding inking zone actuating element, and reducing the measured actual value.

18. The method of claim 17 further comprising determining at least one adjacent area coverage value from data from the subject in at least one circumferential strip immediately adjacent to the circumferential strip covered by the measurement region, and modifying the control deviations based on said at least one adjacent area coverage value.

19. The method of claim 18 comprising determining adjacent area coverage values from the data from the subject in a plurality of circumferential strips adjacent to the circumferential strip covered by the measurement region, weighting the adjacent area coverage values based on distance of each adjacent circumferential strip from the circumferential strip covered by the measurement region, and modifying the control deviations based on the weighted adjacent area coverage values.

20. The method of claim 16 further comprising determining when there is a minimum ink drop off in the circumferential strip covered by the measurement region, and, when there is a minimum ink drop off, modifying the control deviations by at least one of reducing the predefined intended value for the corresponding inking zone actuating element, and increasing the measured actual value.

21. Method for controlling inking in at least one inking unit of an offset press, the inking unit having inking zone actuating elements which control zonal inking of a printing material printed with a subject and measurement regions, wherein the subject comprises inking zones corresponding to respective inking zone actuating elements, each inking zone covering a circumferential strip and having a width, at least one measurement region being measured for each said inking zone, each said measurement region covering a circumferential strip and having a width which is less than the width of the respective said inking zone, said method comprising:

measuring inking parameters of said measurement regions;

determining an area coverage value dependent on a ghosting behavior of the respective inking unit using a model of the respective inking unit and data from the subject in the circumferential strip covered by the measurement region, comparing the area coverage value to a predefined limiting value and, when said area coverage value is greater than said predefined limiting value, modifying the control deviations by at least one of reducing a predefined intended value for the corresponding inking zone actuating element, and increasing the measured actual value; and generating actuating signals for the inking zone actuating elements based on the modified control deviations.

22. The method of claim 21 further comprising determining an area coverage value for the circumferential strip covered by the measurement region that lies one developed length of at least one ink applicator roll before the circumferential strip is covered by the measurement region.

23. The method of claim 22 comprising determining adjacent area coverage values for the circumferential strips covered by the measurement regions that lie one developed length of two respective ink applicator rolls before the circumferential strip covered by the measurement region, modifying the control deviations based on said adjacent area coverage values.

* * * * *